US006814181B2

(12) United States Patent
Abe et al.

(10) Patent No.: US 6,814,181 B2
(45) Date of Patent: Nov. 9, 2004

(54) ELECTRICALLY CONDUCTIVE DAMPER DEVICE FOR SPEAKER

(75) Inventors: Yasuhisa Abe, Yamagata (JP); Koji Matsumoto, Yamagata (JP); Koji Takayama, Yamagata (JP); Hiroyuki Tomiyama, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 330 days.

(21) Appl. No.: 09/982,750

(22) Filed: Oct. 22, 2001

(65) Prior Publication Data

US 2002/0112914 A1 Aug. 22, 2002

(30) Foreign Application Priority Data

Feb. 16, 2001 (JP) ..... 2001-040195

(51) Int. Cl.[7] ..... G10K 13/00

(52) U.S. Cl. ..... 181/166; 181/157; 181/163; 181/169; 181/168; 181/170

(58) Field of Search ..... 181/166, 157, 181/163, 169, 168, 170

(56) References Cited

U.S. PATENT DOCUMENTS 1,480,785 A * 1/1924 Semple, Jr. ..... 181/166
5,125,473 A * 6/1992 Sakamoto et al. ..... 181/116

* cited by examiner

*Primary Examiner*—Shih-Yung Hsieh
(74) *Attorney, Agent, or Firm*—Sughrue Mion, PLLC

(57) ABSTRACT

There is provided an electrically conductive damper device for a speaker in which local bending is reduced and breakdowns of material of the damper and metallic wires incorporated in the damper are prevented, by additionally providing one or more sheets of damper fabric as a reinforcing damper 142 and by bonding it to a main damper 141 by way of various kinds of resin, in order to reinforce a neck portion of the electrically conductive damper. Further, properties of the damper can be adjusted by varying an outer diameter of the reinforcing damper 142, or by selecting the resin to be employed as an adhesive.

7 Claims, 2 Drawing Sheets

ELECTRICALLY CONDUCTIVE DAMPER DEVICE FOR SPEAKER

BACKGROUND OF THE INVENTION

1. Field of the Invention

The present invention relates to an electrically conductive damper device for a speaker, which can be advantageously used in such a speaker as having a large amplitude.

2. Description of the Related Art

In the production of the speaker, an electrically conductive member for inputting voice signals into a voice coil has been integrally attached to a damper in many cases, for the purpose of decreasing number of wiring works. For this purpose, the damper has been composed of damper material such as a fabric or non-woven fabric provided with corrugations, and the electrically conductive member which is formed of braided metallic wires according to a shape of the corrugations and incorporated into the damper material by sewing with fibers such as threads.

However, the above described damper has had poor applicability, because when it has been assembled into the speaker having the large amplitude, a neck portion of the damper and its surrounding area may be locally bent, resulting in break-downs of the damper material and the braided metallic wires.

The present invention has been made in view of the above described circumstances, and it is an object of the invention to provide an electrically conductive damper device for a speaker in which an additional reinforcing damper is attached to a main damper in order to reinforce a neck portion of the electrically conductive damper, and these two sheets of dampers are bonded to each other by means of resin, whereby a local bending is reduced, and break-downs of the damper material and the braided metallic wires can be prevented.

It is also an object of the invention to provide an electrically conductive damper device for a speaker in which properties of the damper can be adjusted by varying an outer diameter of the reinforcing damper or selecting the resin as an adhesive.

SUMMARY OF THE INVENTION

In order to solve the above described problems, there is provided according to the invention, an electrically conductive damper device for a speaker comprising a main damper which is formed of damper material having metallic wires attached thereto, and a reinforcing damper which is attached to a part of the main damper on which a voice coil bobbin is mounted.

According to the above described structure, an additional sheet of the damper material is attached to the main damper for the purpose of reinforcing a neck portion of the electrically conductive damper, and break-downs of the damper material and the metallic wires incorporated therein can be prevented.

In the electrically conductive damper device for the speaker according to another aspect of the invention, the damper material is formed of a fabric impregnated with thermosetting resin, and the metallic wires are formed of electrically conductive material, the main damper being formed by attaching the metallic wires to the fabric by sewing.

This will moderate a local bending of the damper and can prevent break-downs of the damper material and the metallic wires incorporated therein.

In the electrically conductive damper device for the speaker according to a further aspect of the invention, the reinforcing damper is attached to such an area of the main damper that a local bending occurring at the mounting part of the voice coil bobbin when the voice coil bobbin is driven by a voice coil may be reduced, whereby the material of the main damper and the metallic wires may be prevented from breaking down.

According to this structure, in the area of the main damper provided with the reinforcing damper, a local bending will be reduced. Because the outer peripheral area will be adequately bent on the other hand, the local bending will be moderated, and the break-downs of the damper material and the metallic wires which have been incorporated will be prevented.

In the electrically conductive damper device for the speaker according to still another aspect of the invention, the main damper and the reinforcing damper are bonded to each other by means of an adhesive.

By selecting the resin to be employed for bonding, properties of the damper can be adjusted and the break-downs of the damper material and the metallic wires which have been incorporated will be prevented.

In the electrically conductive damper device for the speaker according to a still further aspect of the invention, the adhesive has an inner loss to such an extent that sympathetic vibrations of the electrically conductive damper occurring when the voice coil bobbin is driven may be dampened.

By thus selecting the resin having the large inner loss as the adhesive, an anti-vibration effect of dampening sympathetic vibrations of the damper caused by the metallic wires which have been incorporated can be attained.

In the electrically conductive damper device for the speaker according to a still further aspect of the invention, the main damper and the reinforcing damper are bonded to each other by applying the adhesive.

By selecting the resin to be employed for bonding, the properties of the damper can be adjusted and the break-downs of the damper material and the metallic wires which have been incorporated will be prevented.

In the electrically conductive damper device for the speaker according to a still further aspect of the invention, the main damper and the reinforcing damper are bonded to each other by sandwiching the adhesive between them and by fusion bonding.

This enables the break-downs of the damper material and the metallic wires incorporated therein to be prevented.

DESCRIPTION OF THE PREFERRED EMBODIMENT

Figure 1:
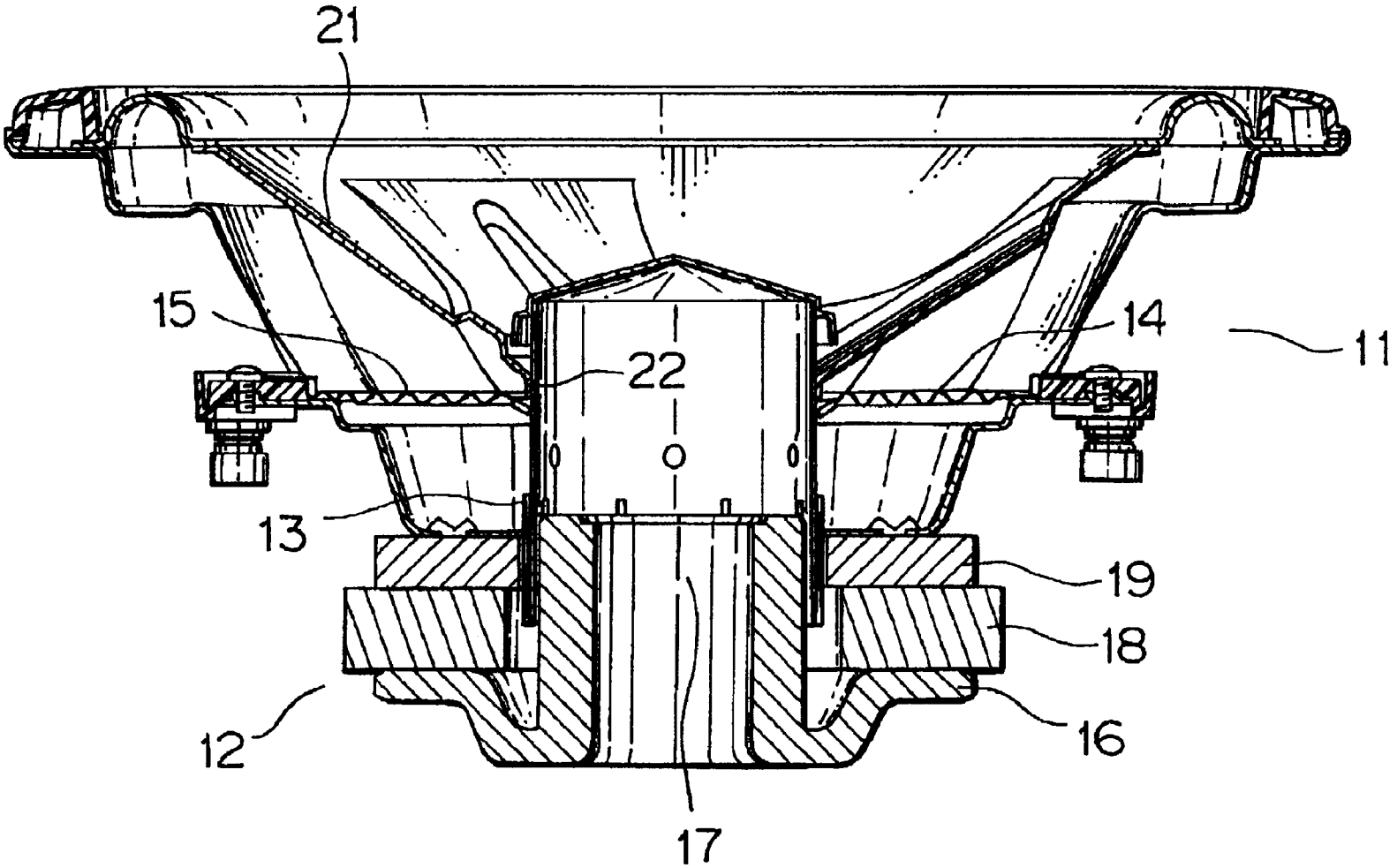
FIG. 1 is a sectional view showing a structure of a speaker apparatus in which an electrically conductive damper device for a speaker according to the present invention is incorporated.

Referring now to FIG. 1, an electrically conductive damper device for a speaker according to the present invention usually consists of a damper member 14 having a number of corrugations 15 concentrically formed thereon, and another sheet of damper material which is attached to a neck portion of the damper member 14, near a voice coil bobbin 22, for the purpose of reinforcing the neck portion, and bonded by resin as described below. A specific structure and movements of the damper device while vibrating are illustrated in FIGS. 2 and 3.

In FIG. 1, numeral 11 generally represents a speaker apparatus, 12 represents a magnetic circuit, 16 represents a yoke, 17 represents a center pole, 18 represents a magnet, 19 represents a top plate, 21 represents a vibration diaphragm, 22 represents a voice coil bobbin, and 13 represents a voice coil. The yoke 16, the center pole 17, the magnet 18 and the top plate 19 constitute the magnetic circuit 12. The voice coil 13 and the vibration diaphragm 21 constitute a vibration system.

Figure 2:
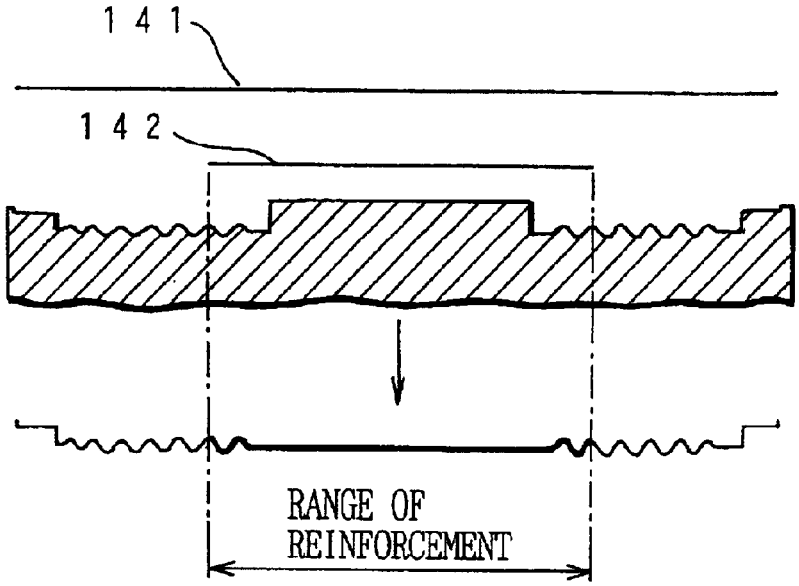
FIG. 2 is a view cited for reference for explaining a process for producing the electrically conductive damper device for a speaker according to the present invention.
Figure 3:
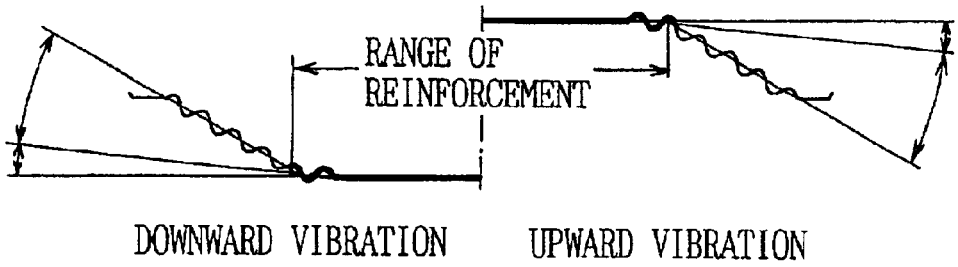
FIG. 3 is a view cited for reference for explaining movements of the electrically conductive damper device for a speaker according to the present invention, while vibrating (upward vibration and downward vibration)

FIG. 2 is a view cited for reference for explaining a process for producing the electrically conductive damper device for a speaker according to the present invention.

As shown in FIG. 2, the electrically conductive damper device consists of a main damper 141 and a reinforcing damper 142. The main damper 141 includes metallic wires incorporated therein by sewing, and thermosetting resin such as phenol resin or melamine resin which has been applied to or impregnated in the main damper before or after the metallic wires have been incorporated.

The reinforcing damper 142, as well as the main damper 141, has thermosetting resin such as phenol resin or melamine resin applied to or impregnated therein, and is formed into an annular shape by stamping out its inner and outer peripheries.

Then, an adhesive is applied to mating faces between the main damper 141 and the reinforcing damper 142, and they are subjected to a heating press and stamped simultaneously into a shape of the damper. Thus, the damper member 14 can be obtained, by bonding the main damper 141 and the reinforcing damper 142 to each other, at the same time with shaping them. It is also possible that instead of applying the adhesive, a coating agent or a laminate film may be sandwiched between the main damper 141 and the reinforcing damper 142.

A fabric or non woven fabric such as cotton, aramid fiber etc. may be employed as material of the main damper 141 and the reinforcing damper 142, to which the thermosetting resin as described above is applied or impregnated. Both ends of a braid of the metallic wires which are incorporated in the damper member 14 to compose the electrically conductive damper are connected respectively to the voice coil 13 and to an exterior input terminal. Audio signals inputted into the exterior terminal are applied to the voice coil 13 through the braid of the metallic wires, and the speaker apparatus as shown in FIG. 1 will be thus actuated.

In the drawings, an area of the main damper 141 overlapped with the reinforcing damper 142 is defined as a range of reinforcement having double sheets.

Figure 4:
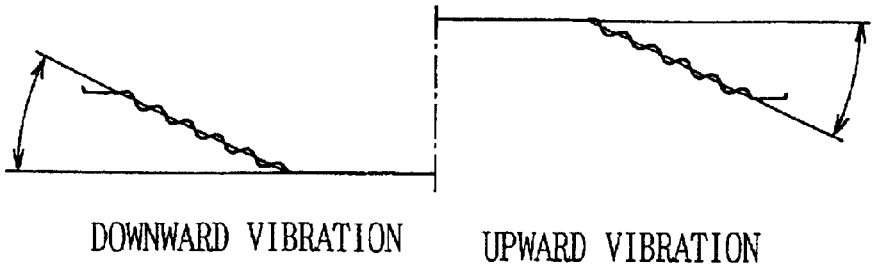
PRIOR ART FIG. 4
FIG. 4 is a view cited for reference for explaining movements of the electrically conductive damper device for a speaker in a conventional example, while vibrating (upward vibration and downward vibration).

FIG. 3 is a view cited for reference for explaining movements of the electrically conductive damper device for a speaker according to the present invention, while vibrating (upward vibration and downward vibration).For comparison, FIG. 4 shows movements of the conventional damper device.

As described above, the electrically conductive damper device for the speaker according to the present invention consists of the main damper 141, and another sheet of damper material attached to the neck portion of the main damper 141 for the purpose of reinforcement as the reinforcing damper 142. In this embodiment, the two sheets of the damper material are bonded to each other with various kinds of resin.

As apparent from FIG. 3, according to the present invention, in the area of the main damper 141 provided with the reinforcing damper 142, a local bending will be reduced, in other words, the bending at the neck portion will be dispersed. Because the outer peripheral area will be adequately bent on the other hand, the local bending will be moderated, and break-downs of the damper material and the metallic wires which have been incorporated will be prevented.

Further, by varying an outer diameter of the reinforcing damper, properties of the damper can be adjusted. More specifically, in case where the diameter of the reinforcing damper 142 is made larger, strength of the damper in its entirety will be increased. On the other hand, in case where the diameter of the reinforcing damper 142 is made smaller so as to be attached only to the area near the neck portion, the strength of the main damper 141 around the neck portion can be enhanced, while characteristics of the main damper 141 are maintained.

The latter treatment may be an effective measure, because in modern speakers, the neck portion of the damper is the weakest point in strength and break-downs spreading from the neck portion are prominent. Moreover, in case where advantage should be taken of the characteristics of only the main damper 141, for example, in a speaker in which a special emphasis is placed on quality of sound, it is possible to restrict the range of reinforcement to a minimum around the neck portion.

On the other hand, by selecting the resin to be employed for bonding the reinforcing damper 142 to the main damper 141, properties as the damper can be adjusted. The resin to be employed here includes, for example, polyamide resin, urethane, acryl, NBR (acrylonitril-butadiene rubber), SBR (styrene-butadiene rubber). Particularly, by employing the resin having a large inner loss, an effect for dampening sympathetic vibrations of the damper caused by the incorporated metallic wires can be expected.

As described herein above, the present invention can provide an electrically conductive damper device for a speaker in which a local bending is reduced and break-downs of the material of the damper and the metallic wires are prevented, by additionally providing one or more sheets of damper fabric as the reinforcing damper and by bonding it to the main damper by way of various kinds of resin, in order to reinforce the neck portion of the electrically conductive damper. Further, the properties of the damper can be adjusted by varying the outer diameter of the reinforcing damper, or by selecting the resin to be employed as the adhesive.

Although the present invention has been fully described by way of examples with reference to the accompanying drawings, it is to be noted that various changes and modifications can be made within the scope of the present invention. Incidentally, the contents of Japanese Patent Application No. 2001-040195 are hereby incorporated by reference.

What is claimed is:

1. An electrically conductive damper device for a speaker comprising a main damper which is formed of damper material having metallic wires attached thereto, and a reinforcing damper which is attached to a part of said main damper on which a voice coil bobbin is mounted.

2. The electrically conductive damper device for the speaker as claimed in claim 1, wherein said damper material is formed of a fabric impregnated with thermosetting resin, and said metallic wires are formed of electrically conductive material, said main damper being formed by attaching said metallic wires to said fabric by sewing.

3. The electrically conductive damper device for a speaker as claimed in claim 1, wherein said reinforcing damper is attached to such an area of said main damper that a local bending occurring at said mounting part of said voice coil bobbin when said voice coil bobbin is driven by a voice coil is reduced and the, material of said main damper and the metallic wires are prevented from breaking down.

4. The electrically conductive damper device for the speaker as claimed in claim 1, wherein said main damper and said reinforcing damper are bonded to each other by means of an adhesive.

5. The electrically conductive damper device for a speaker as claimed in claim 4, wherein the adhesive has an inner loss to such an extent that sympathetic vibrations of said electrically conductive damper occurring when said voice coil bobbin is driven are dampened.

6. The electrically conductive damper device for the speaker as claimed in claim 4, wherein said main damper and said reinforcing damper are bonded to each other by applying said adhesive.

7. The electrically conductive damper device for the speaker as claimed in claim 4, wherein said main damper and said reinforcing damper are bonded to each other by sandwiching said adhesive between them and by fusion bonding.

* * * * *